US012496679B2

(12) United States Patent
Zhao et al.

(10) Patent No.: US 12,496,679 B2
(45) Date of Patent: Dec. 16, 2025

(54) POLISHING FIXING DEVICE AND POLISHING APPARATUS

(71) Applicant: Fulian Yuzhan Precision Technology Co., Ltd., Shenzhen (CN)

(72) Inventors: Zhi-Gang Zhao, Shenzhen (CN); Hsing-Chih Hsu, New Taipei (TW); Bin Liu, Shenzhen (CN); Chong-Zhen Wang, Shenzhen (CN); Lang Ding, Shenzhen (CN); Xing-Long Zhang, Shenzhen (CN); Zhao-Heng Meng, Shenzhen (CN); Zhi Peng, Shenzhen (CN)

(73) Assignee: Fulian Yuzhan Precision Technology Co., Ltd., Shenzhen (CN)

( * ) Notice: Subject to any disclaimer, the term of this patent is extended or adjusted under 35 U.S.C. 154(b) by 363 days.

(21) Appl. No.: 17/987,796

(22) Filed: Nov. 15, 2022

(65) Prior Publication Data

US 2023/0150087 A1 May 18, 2023

(30) Foreign Application Priority Data

Nov. 15, 2021 (CN) ..... 202111348574.4
Nov. 15, 2021 (CN) ..... 202111350618.7

(51) Int. Cl.
*B24B 37/10* (2012.01)
*B24B 41/02* (2006.01)
(Continued)

(52) U.S. Cl.
CPC ..... *B24B 37/107* (2013.01); *B24B 37/10* (2013.01); *B24B 37/105* (2013.01); *B24B 41/02* (2013.01);
(Continued)

(58) Field of Classification Search
CPC ..... B24B 37/10; B24B 37/105; B24B 37/107; B24B 41/02; B24B 49/16; B24B 55/02;
(Continued)

(56) References Cited

U.S. PATENT DOCUMENTS 5,916,009 A * 6/1999 Izumi ..... B24B 37/04 451/24
5,938,884 A * 8/1999 Hoshizaki ..... B24B 37/32 451/288
(Continued)

FOREIGN PATENT DOCUMENTS

CN 205734260 U 11/2016
CN 207155519 U 3/2018
(Continued)

*Primary Examiner* — C. A. Rivera
(74) *Attorney, Agent, or Firm* — ScienBiziP, P.C.

(57) ABSTRACT

A polishing apparatus includes a polishing device, a polishing fixing device, and a controller. The polishing fixing device includes a rotating mechanism, a sensor, a movement compensation assembly, a first moving assembly and a second moving assembly. The sensor in the polishing fixing device senses pressure applied to the workpiece during polishing, the movement compensation assembly can drive the rotating mechanism to move in compensation, so as to keep the polishing pressure within a certain range for uniformity in polishing, improving the polishing quality and production efficiency of the workpiece.

6 Claims, 13 Drawing Sheets

(51) Int. Cl.
*B24B 49/16* (2006.01)
*B24B 55/04* (2006.01)
*B24B 57/02* (2006.01)

(52) U.S. Cl.
CPC ..... *B24B 49/16* (2013.01); *B24B 55/04* (2013.01); *B24B 57/02* (2013.01)

(58) Field of Classification Search
CPC ..... B24B 55/04; B24B 37/005; B24B 37/27; B24B 37/30; B24B 37/34; G01G 5/00
See application file for complete search history.

(56) References Cited

U.S. PATENT DOCUMENTS 6,217,411 B1 * 4/2001 Hiyama ..... B24B 41/061 451/24
2013/0324012 A1 * 12/2013 Fukushima ..... B24B 37/005 451/283

FOREIGN PATENT DOCUMENTS

| | | | | | |
|---|---|---|---|---|---|
| CN | 213352045 | U | | 6/2021 | |
| JP | 09290367 | A | * | 11/1997 | ..... B24B 37/30 |
| KR | 20000062833 | A | * | 10/2000 | |

* cited by examiner

POLISHING FIXING DEVICE AND POLISHING APPARATUS

TECHNICAL FIELD

The present disclosure relates to the field of polishing workpieces, in particular to a polishing fixing device and a polishing apparatus using the same.

BACKGROUND

With the rapid development of 3C products, high standards are required for the appearance of workpieces. For example, after the processing steps of a workpiece are completed, surfaces of the workpiece need to be polished to achieve a mirror finish. The current polishing method for the workpiece is carried out by rotating or vibrating a polishing head relative to the workpiece along the surfaces of the workpiece for polishing operation. However, during the polishing process for the workpiece, the force between the polishing head and the workpiece cannot be adjusted in real time, it might result in uneven polishing effects on the surfaces of the workpiece by the polishing head, or even poor polishing. Such a polishing method may greatly reduce polishing quality and affect production efficiency of the workpiece.

Therefore, an improved polishing apparatus is desired for achieving a polishing effect with a high quality.

1.

Figure 2:
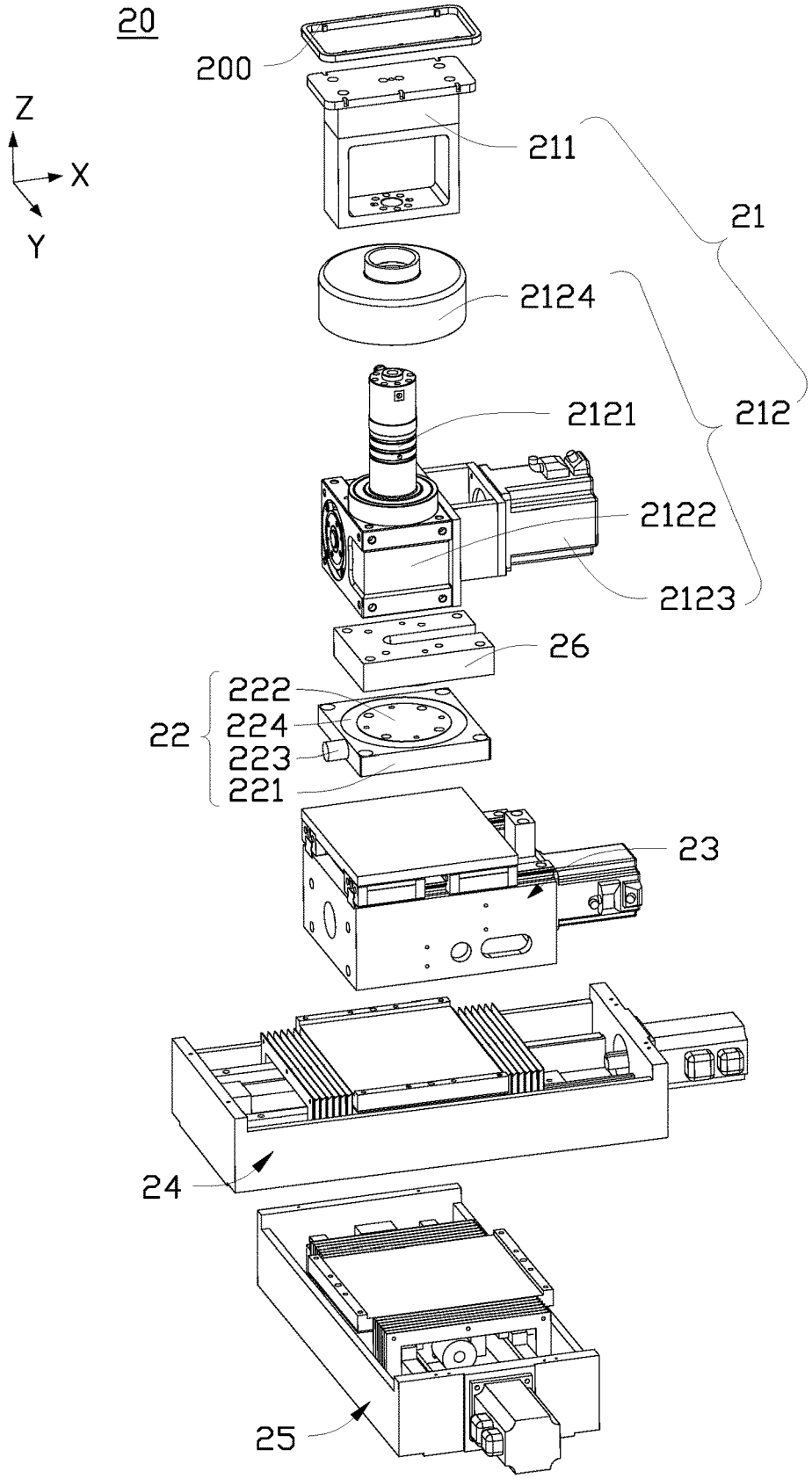

FIG. 2 illustrates an exploded view of a polishing fixing device shown in FIG.

Figure 3:
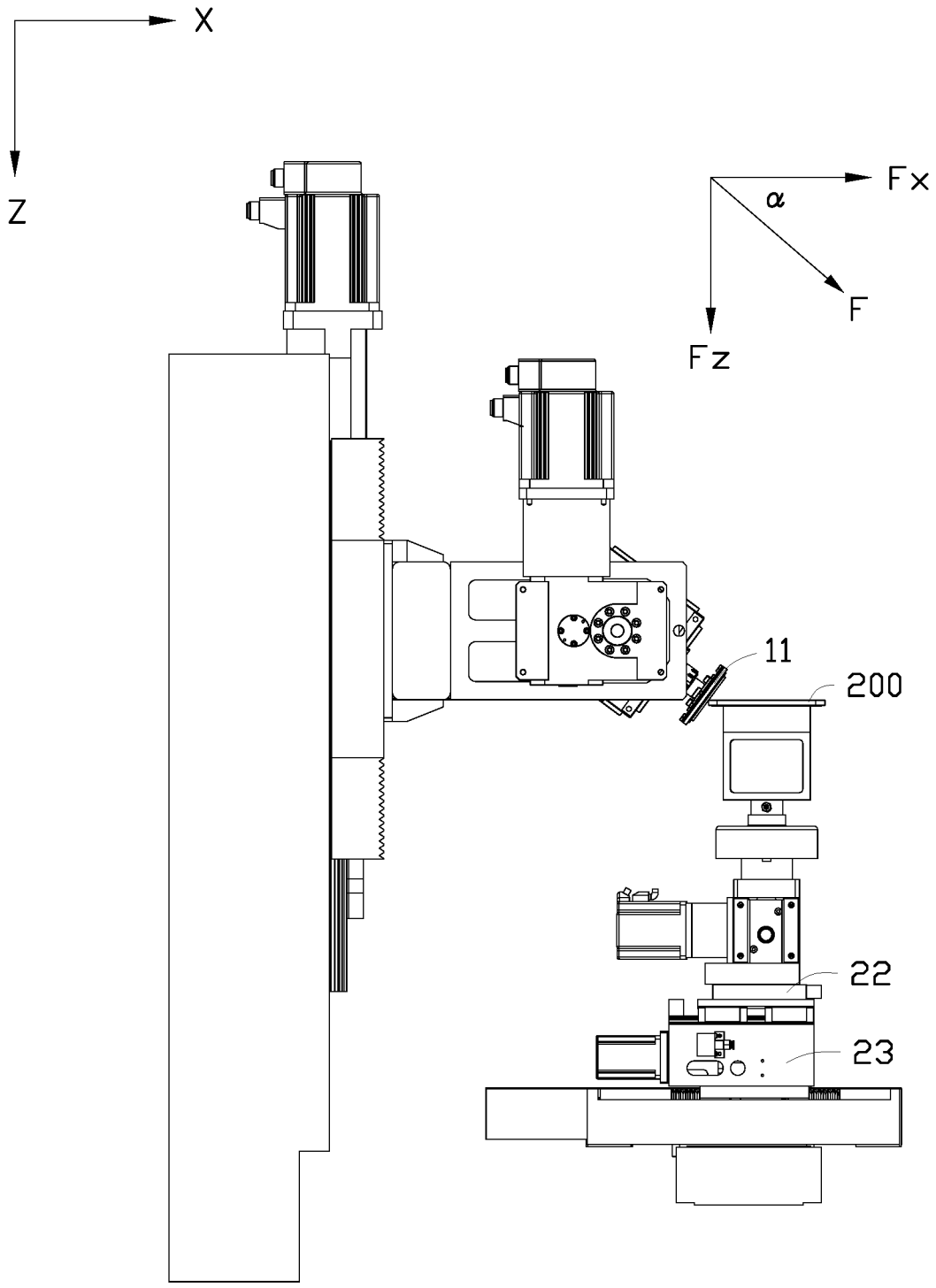

FIG. 3 illustrates a schematic view showing a state of the polishing apparatus polishing a 3 dimensional (3D) surface of the workpiece.

Figure 4:
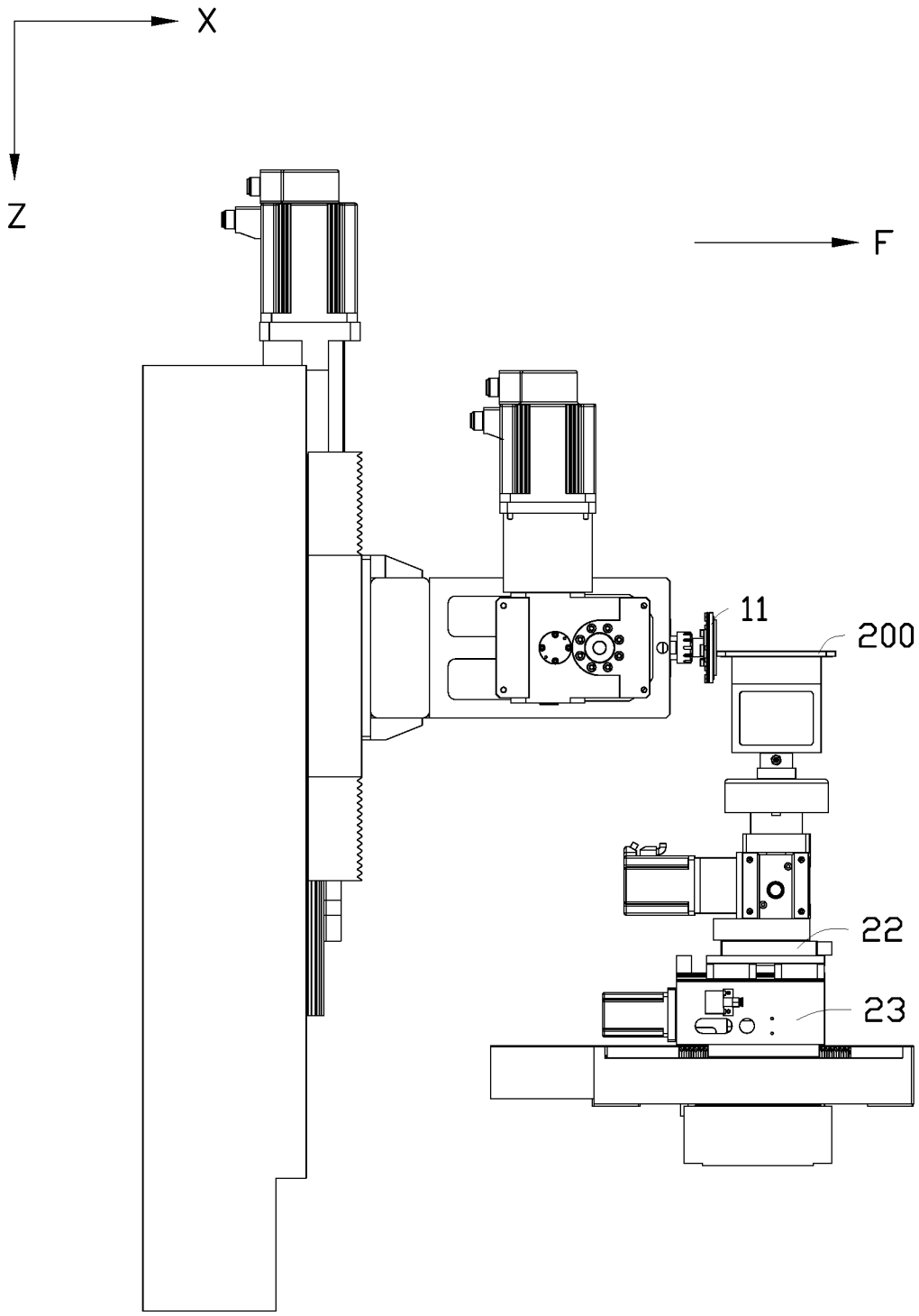

FIG. 4 illustrates a schematic view showing another state of the polishing apparatus polishing a side of the workpiece.

Figure 5:
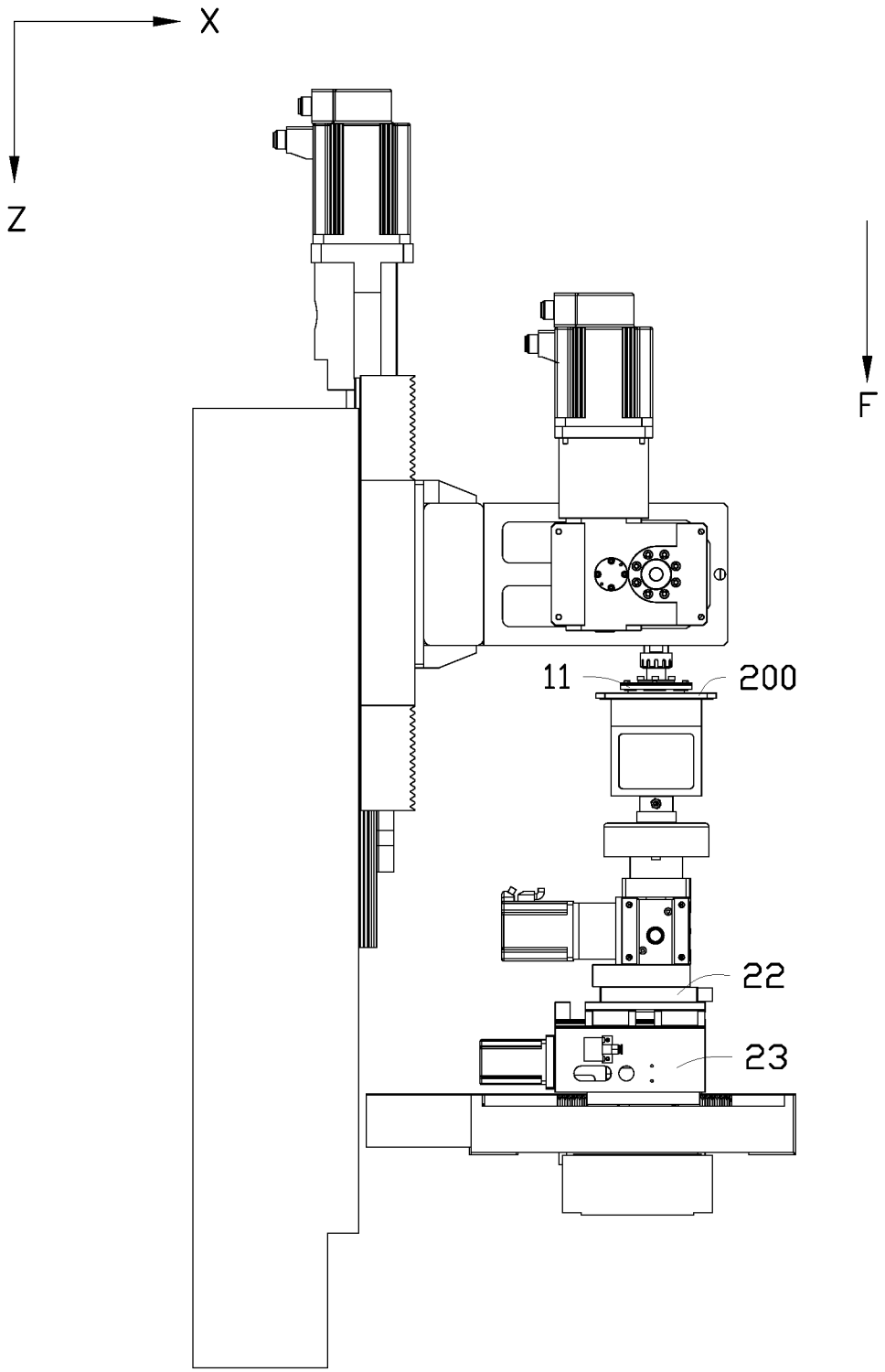

FIG. 5 illustrates a schematic view of another state of the polishing apparatus polishing a top surface of the workpiece.

Figure 6:
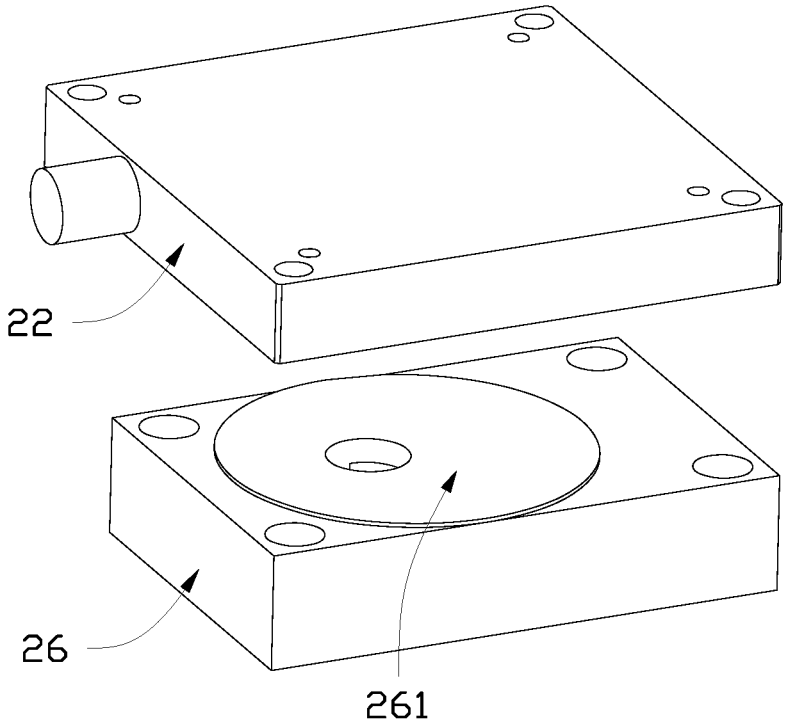

FIG. 6 illustrates a schematic view of a sensor and a connecting plate of the fixing device shown in FIG. 2.

Figure 7:
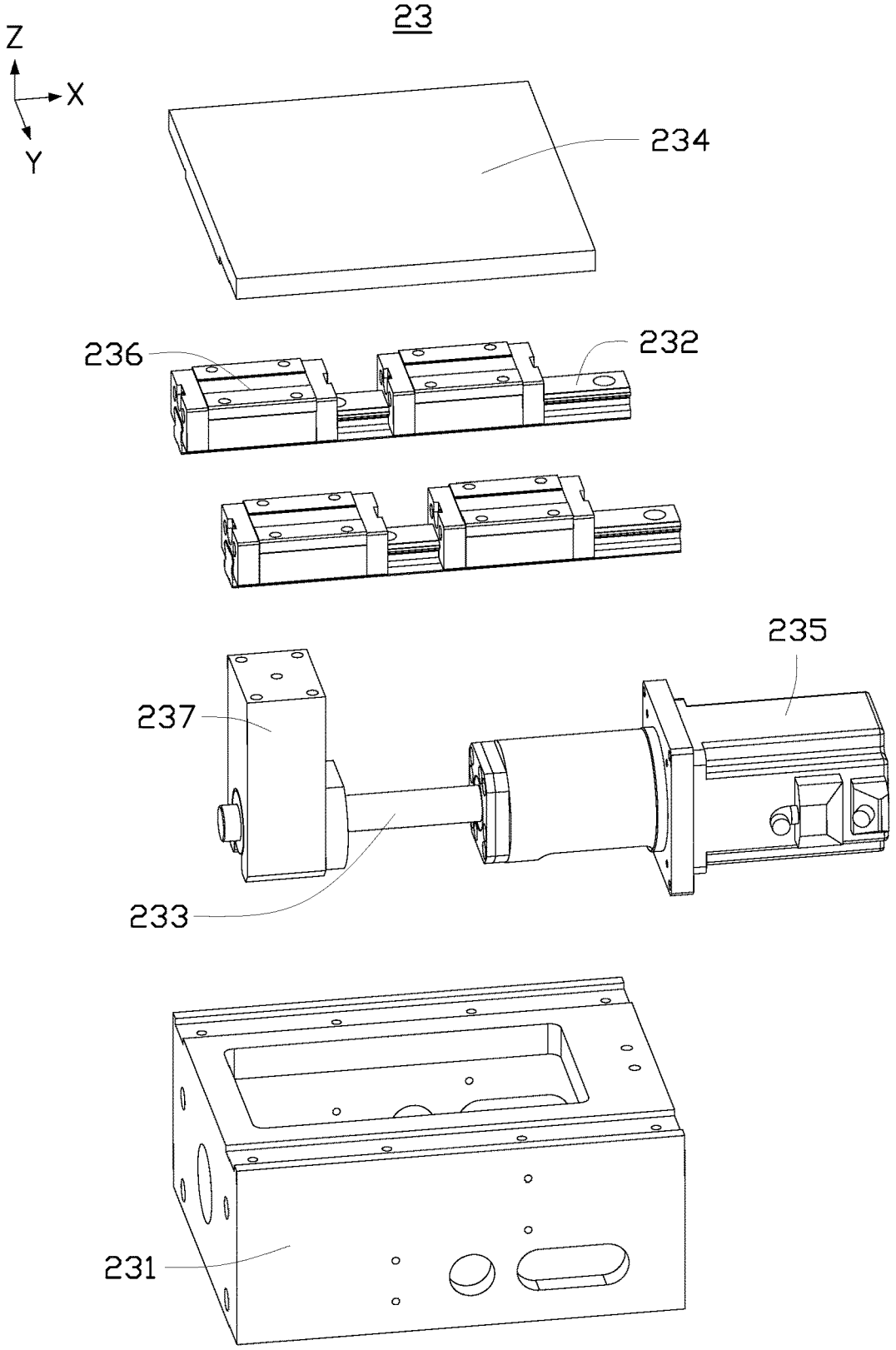

FIG. 7 illustrates an exploded view of a movement compensation assembly of the fixing device shown in FIG. 2.

Figure 8:
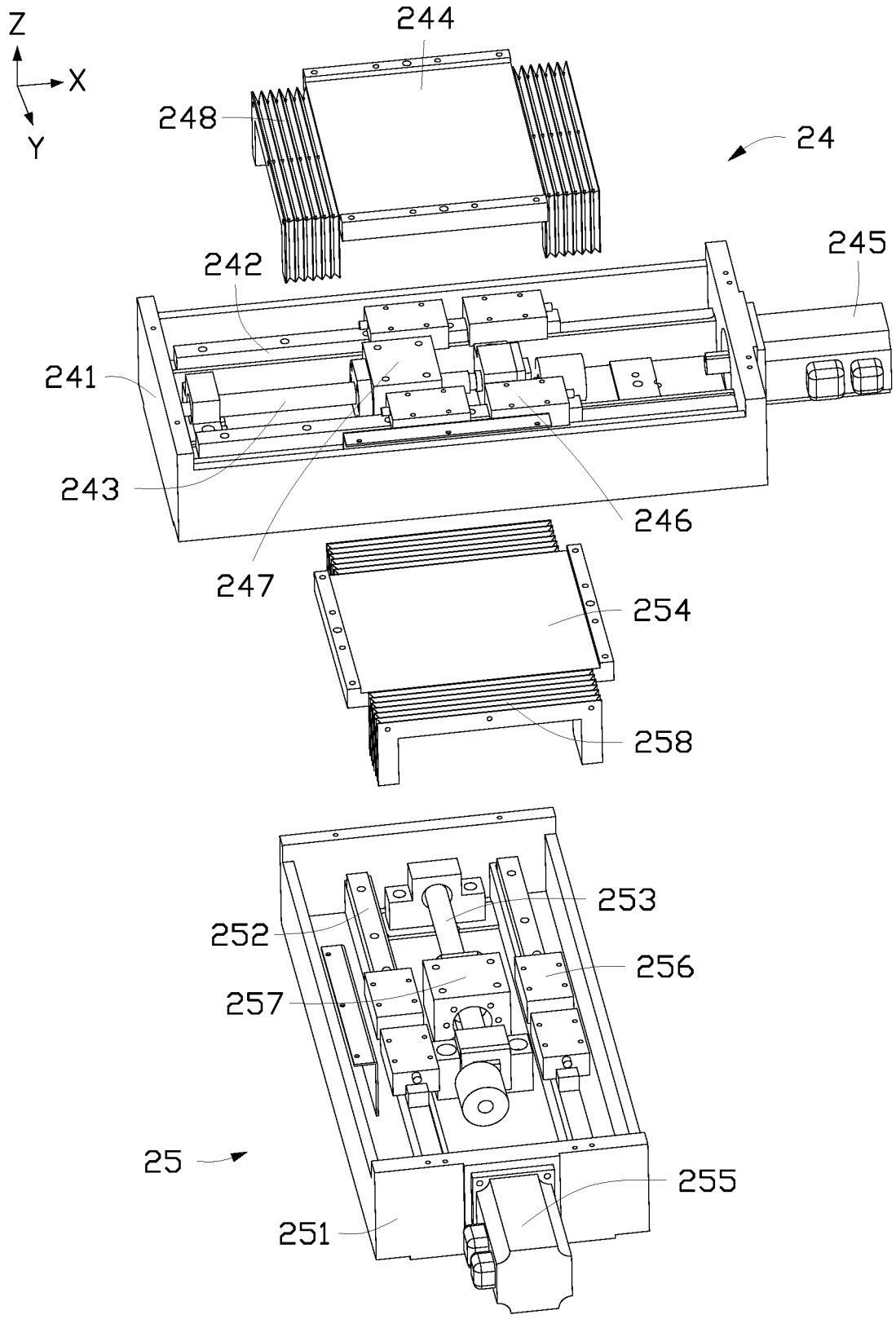

FIG. 8 illustrates an exploded view of a first moving assembly and a second moving assembly of the fixing device shown in FIG. 2.

Figure 1:
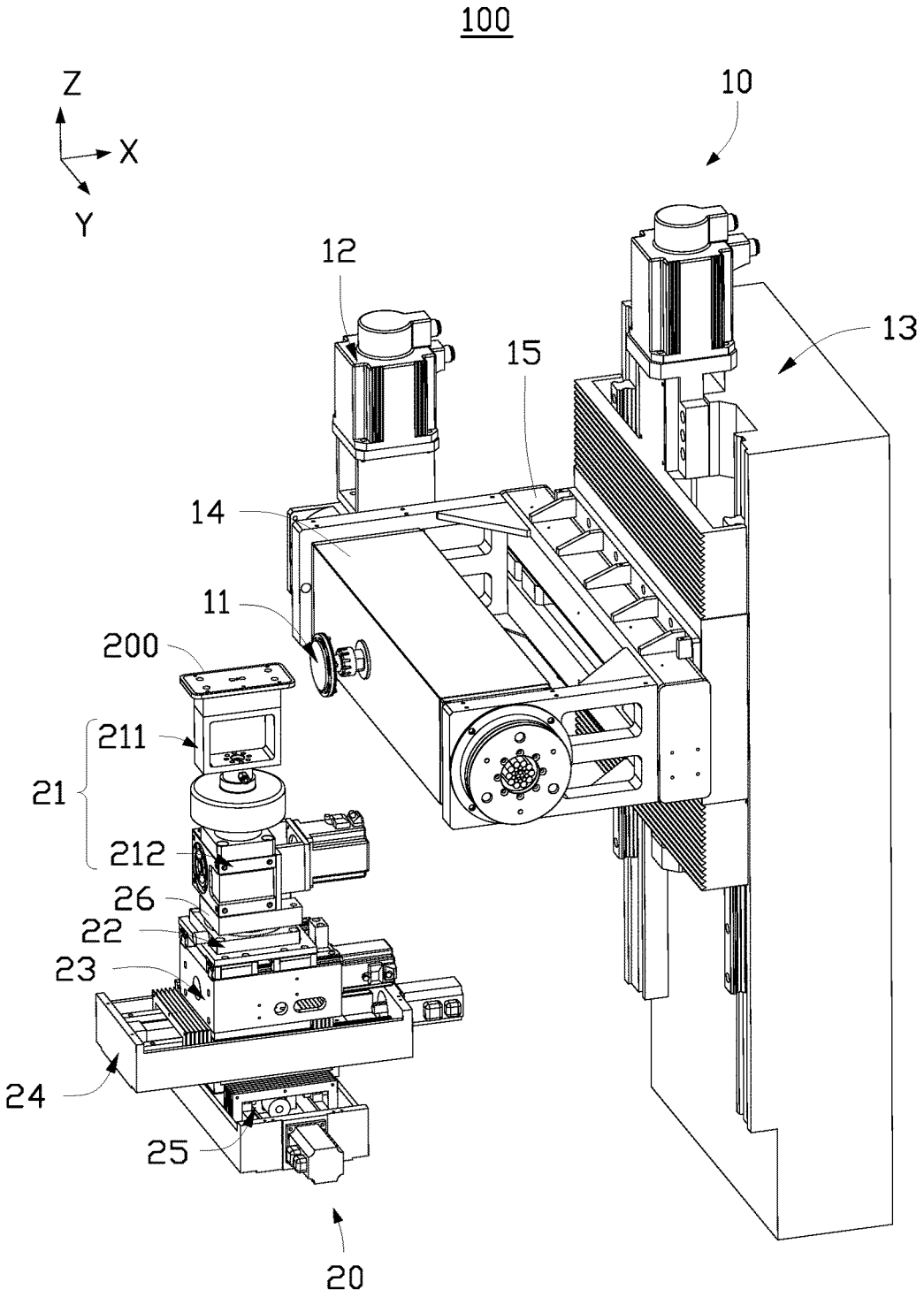
FIG. 1 illustrates an isometric view of at least one embodiment of a polishing apparatus.
Figure 9:
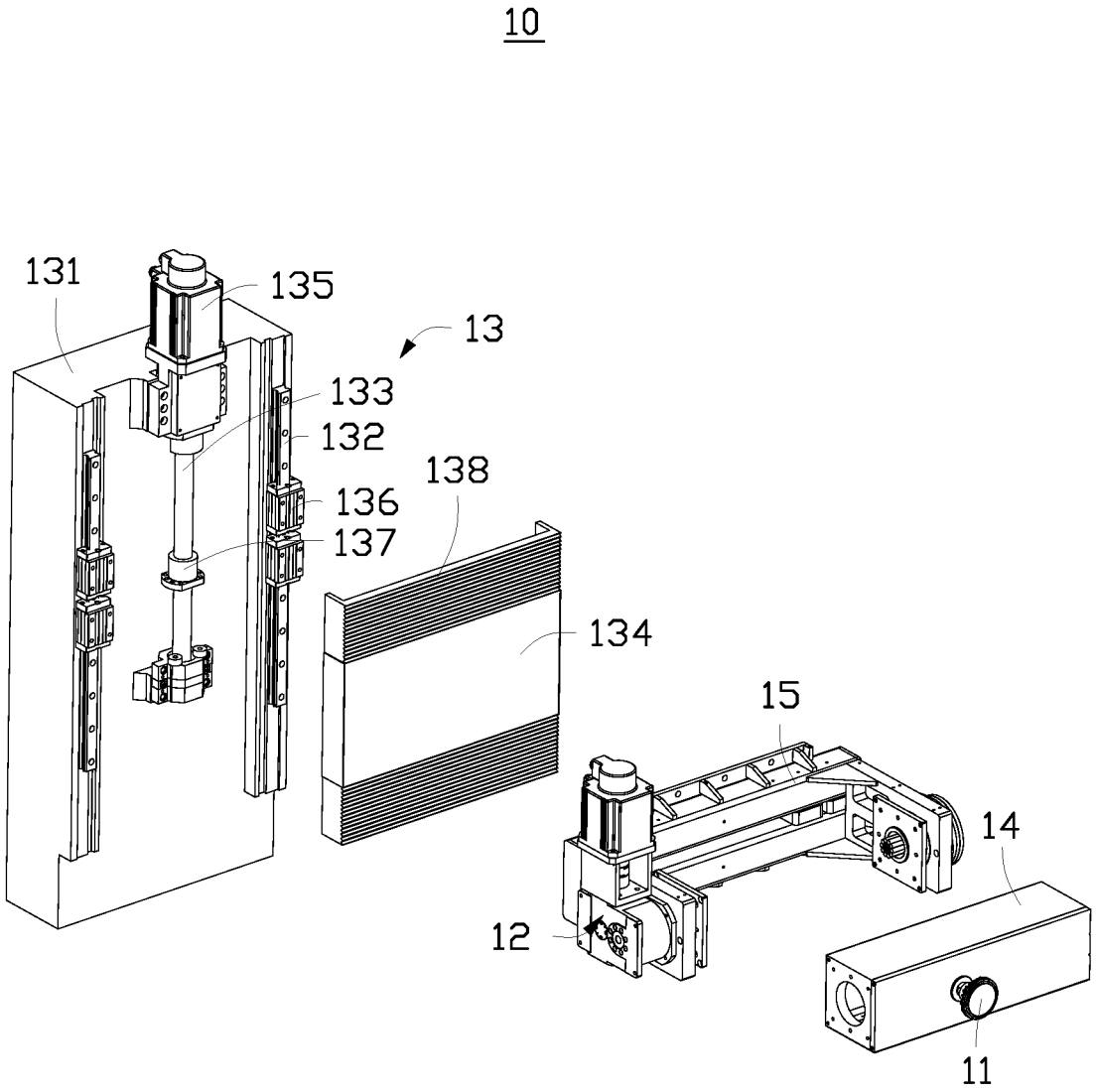

FIG. 9 illustrates an exploded view of a polishing device shown in FIG. 1.

Figure 10:
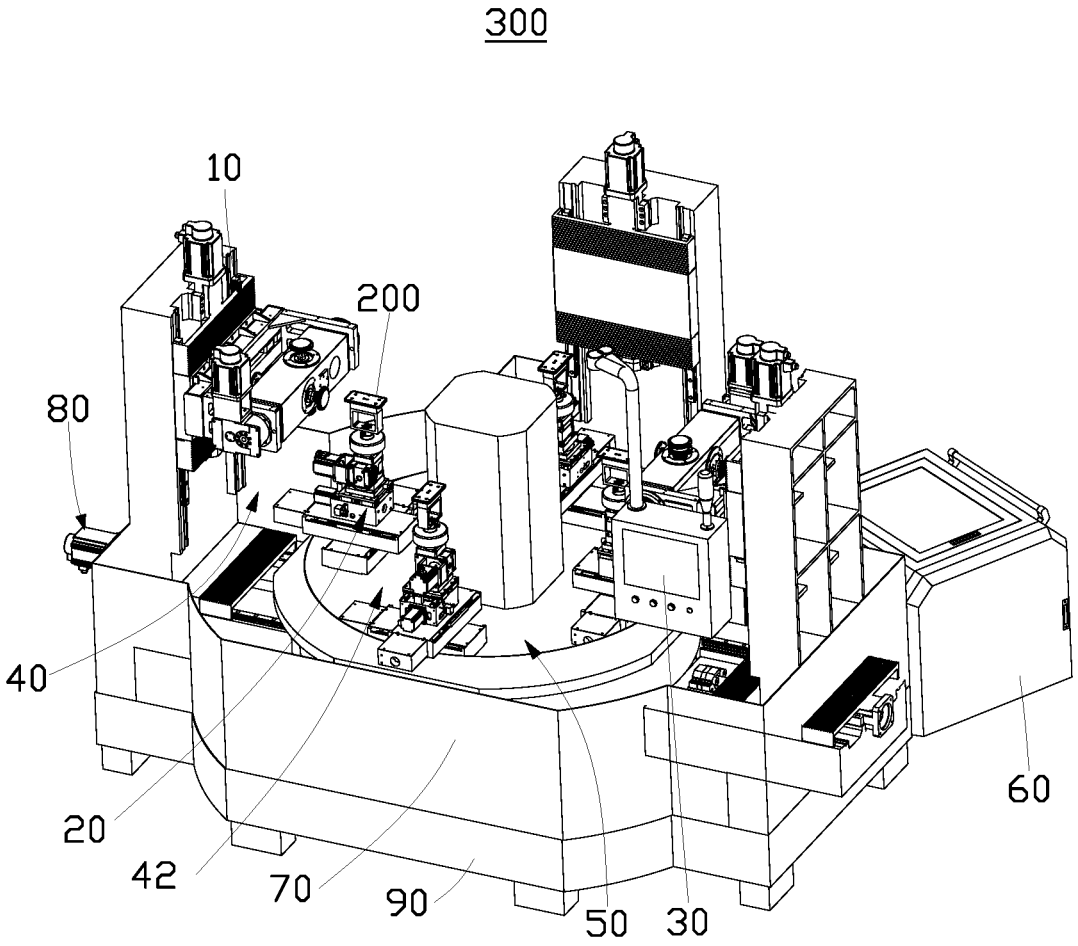

FIG. 10 illustrates a schematic view of at least one embodiment of another polishing apparatus.

Figure 11:
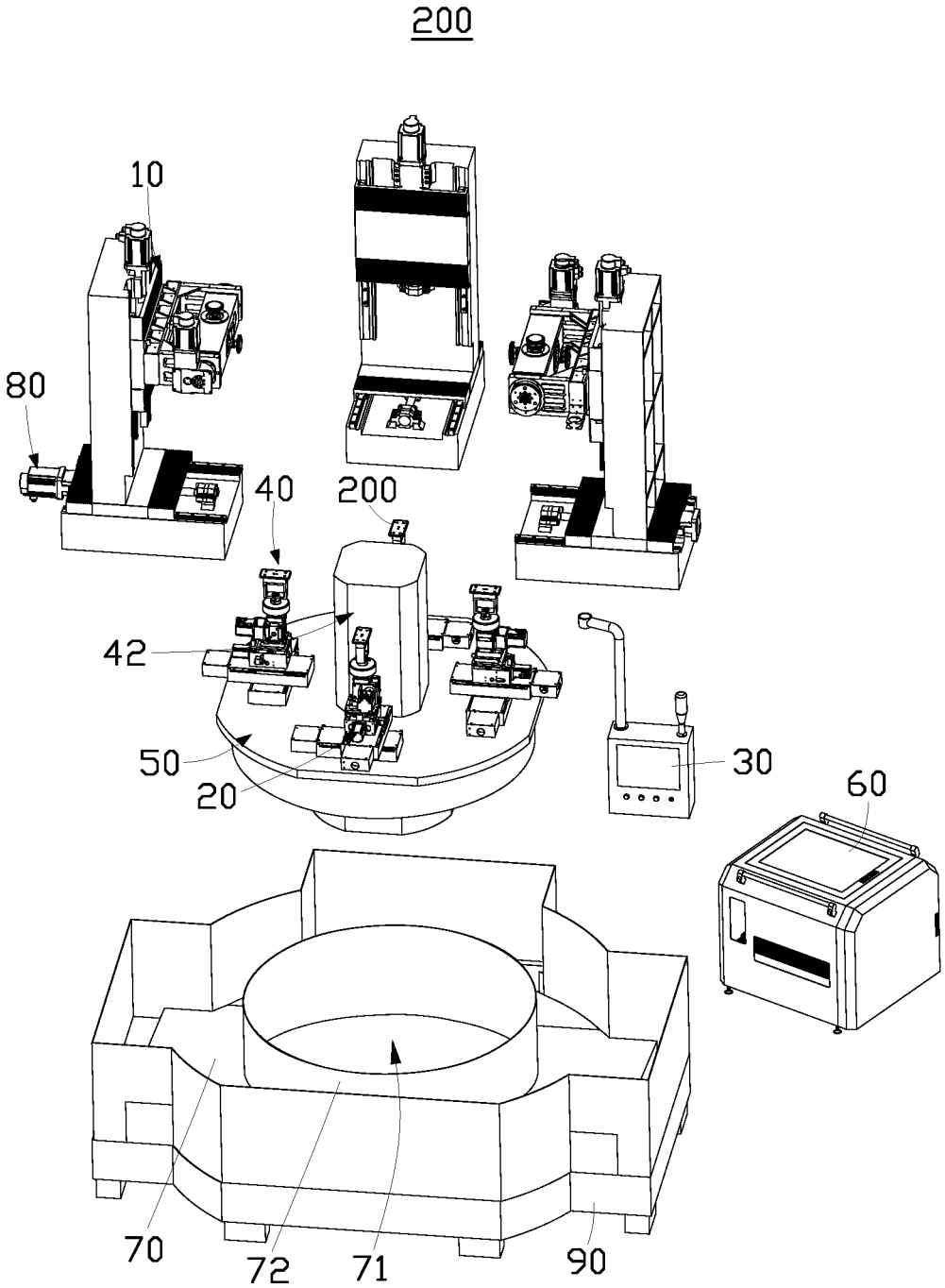

FIG. 11 illustrates an exploded view of the polishing apparatus shown in FIG. 10.

Figure 12:
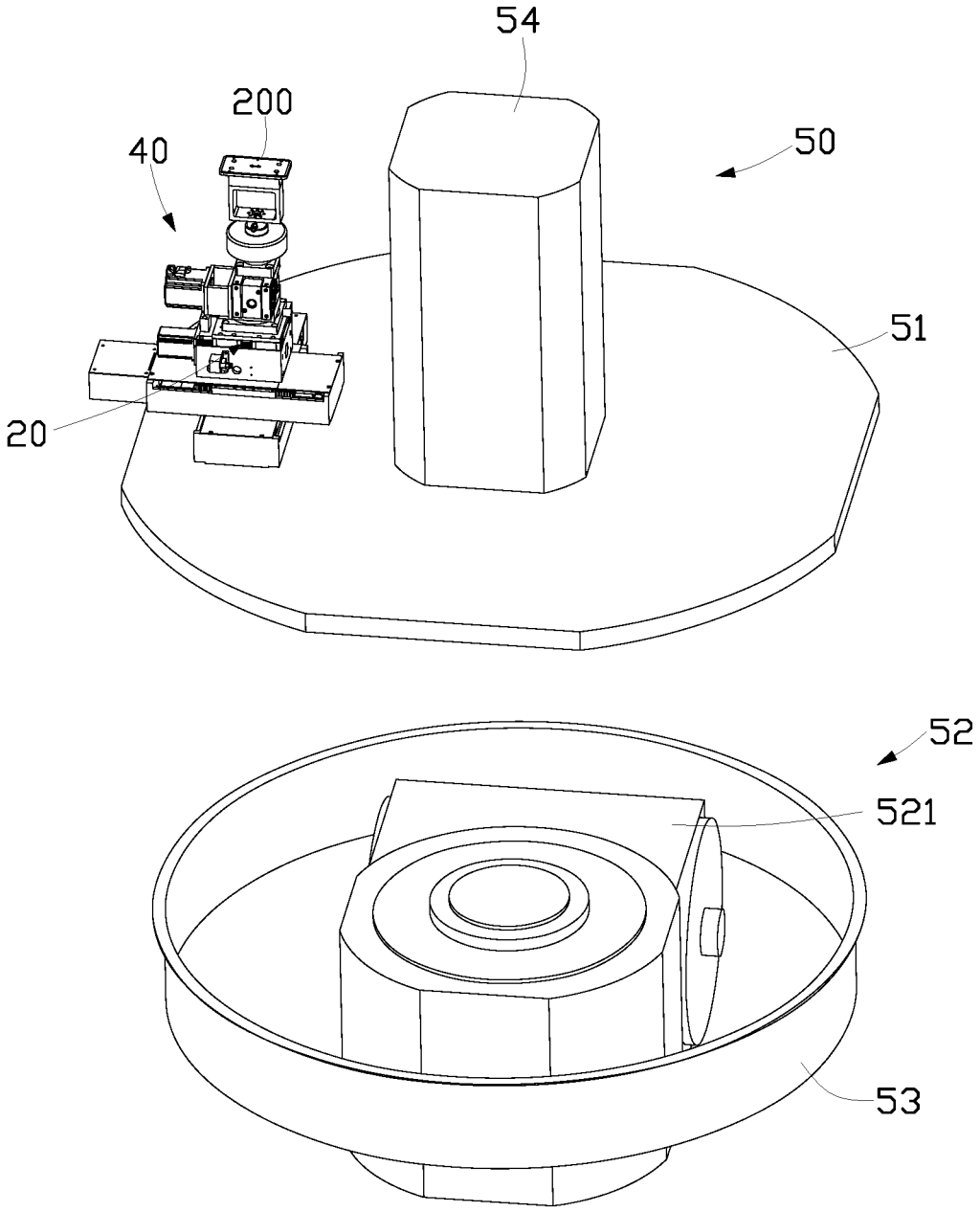

FIG. 12 illustrates an exploded view of a rotating device of the apparatus shown in FIG. 11.

Figure 13:
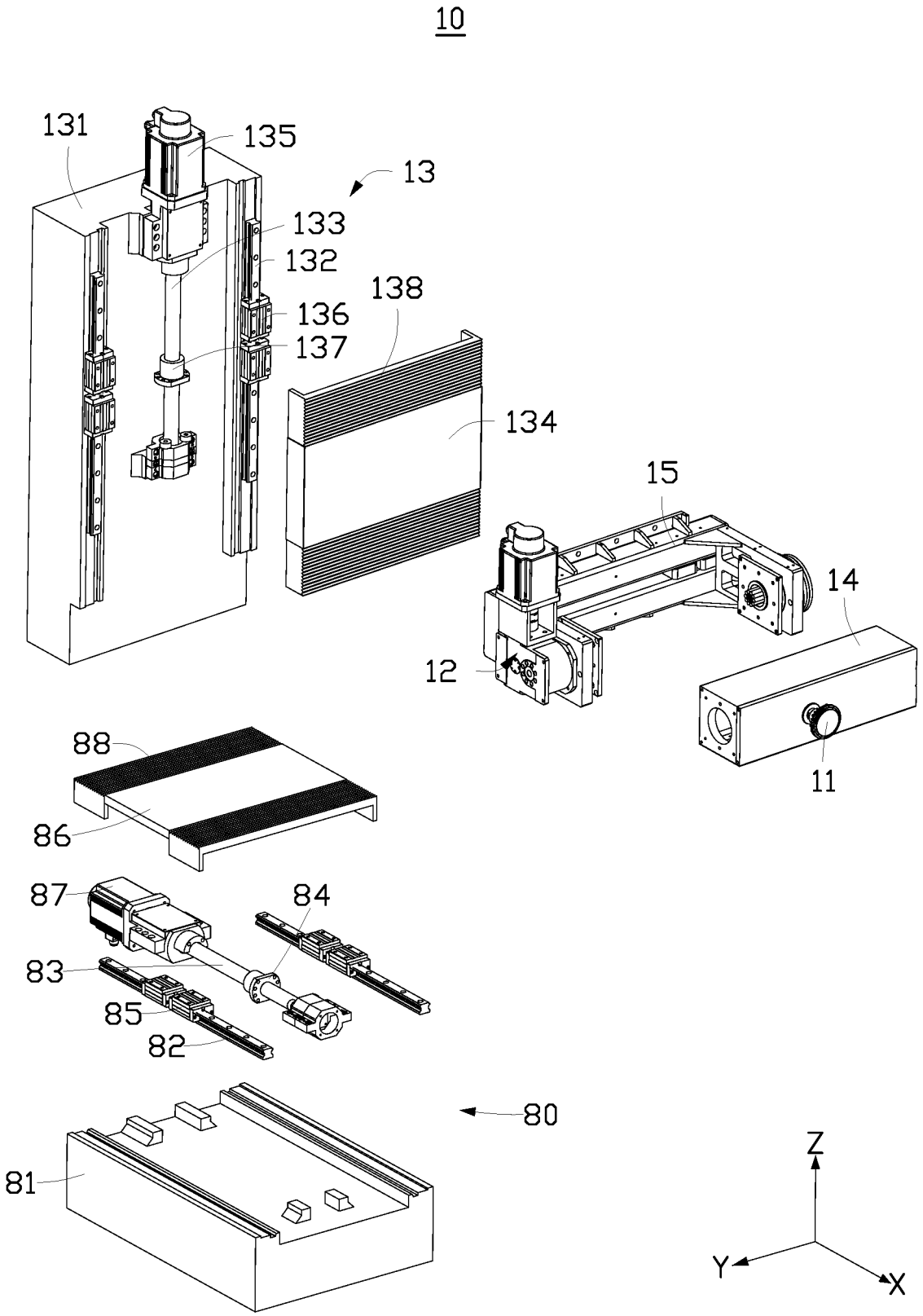

FIG. 13 illustrates an exploded view of a polishing moving mechanism of the apparatus shown in FIG. 11.

DETAILED DESCRIPTION

The embodiments of the disclosure are described in detail below. The examples of the embodiments are shown in the drawings, in which the same or similar labels throughout represent the same or similar elements or elements with the same or similar functions. The embodiments described below with reference to the accompanying drawings are exemplary and are only used to explain the disclosure, but cannot be understood as restrictions on the disclosure.

In the description of the disclosure, it should be understood that the terms "first" and "second" are only used for description purposes and cannot be understood as indicating or implying relative importance or implicitly indicating the number of indicated technical features. Therefore, the features defined as "first" and "second" can explicitly or implicitly include one or more relevant features. In the description of the disclosure, it should be noted that "multiple" means two or more, unless otherwise specified.

The embodiments of the present disclosure are described in detail below in combination with the accompanying drawings.

Referring to FIG. 1, a polishing apparatus 100 is used to polish the workpiece 200. The workpiece 200 can be one part of products such as a frame or a back shell of mobile phone, but not limited to this. The polishing apparatus 100 includes a polishing device 10, a polishing fixing device 20, and a controller (not shown in the figure).

The polishing device 10 includes a polishing assembly 11, and the polishing assembly 11 is used to polish the workpiece 200.

Referring to FIG. 2, the polishing fixing device 20 may include a rotating mechanism 21, a sensor 22, a movement compensation assembly 23, a first moving assembly 24, and a second moving assembly 25. The rotating mechanism 21 is used to fix and drive the workpiece 200 to rotate relative to the polishing assembly 11, so that the workpiece 200 can be moved relative to the polishing assembly 11, and the workpiece 200 is polished by the polishing assembly 11. The sensor 22 is connected to the rotating mechanism 21. The sensor 22 is used to sense the force applied to the workpiece 200 during polishing. This force can be understood as the pressure between the polishing assembly 11 and the workpiece 200 when the polishing assembly 11 is polishing the workpiece 200. If the pressure is too much, the polishing assembly 11 will over polish the workpiece 200. On the contrary, if the pressure is too small, the workpiece 200 will be under polished by the polishing assembly 11. The above two conditions will affect the polishing yield of the workpiece 200. The movement compensation assembly 23 is connected to the rotating mechanism 21. The movement compensation assembly 23 is used to drive the rotating mechanism 21 to move relative to the polishing assembly 11 so that the force between the polishing assembly 11 and the workpiece 200 remains in a preset range. The first moving assembly 24 is connected to the movement compensation assembly 23, the first moving assembly 24 is used to drive the movement compensation assembly 23 and the rotating mechanism 21 to move along a first direction. The second moving assembly 25 is connected to the first moving assembly 24, the second moving assembly 25 is used to drive the first moving assembly 24 to move along a second direction different from the first direction.

For the convenience of explanation, as shown in FIG. 1, the first direction is defined as the X-axis direction, and the second direction is defined as the Y-axis direction. In the embodiment, the first direction is perpendicular to the second direction.

In other embodiments, the first direction and the second direction may be other than vertical, and the included angle between the first direction and the second direction may be 30°, 45°, 60°, 75°, etc.

In the embodiment, a controller is coupled to the polishing device 10 and the polishing fixing device 20. It can also be understood that the controller can also be coupled to the rotating mechanism 21, the sensor 22, the movement compensation assembly 23, the first moving assembly 24, and the second moving assembly 25. The controller is used to control the carrying member 14 to rotate along the central axis to adjust the polishing angle of the polishing assembly 11 relative to the workpiece 200. The central axis of the carrying member 14 is perpendicular to the rotation axis of the polishing assembly 11. The controller is used to control at least one of the polishing fixing device 20 to drive the workpiece 200 to rotate relative to the polishing assembly 11, move along the first direction, move along the second direction, and apply compensation in movement, so as to make the workpiece 200 move relative to the polishing assembly 11. It can also be understood that the controller is used to control at least one of the rotating mechanism 21 to drive the workpiece 200 to rotate relative to the polishing assembly 11, the first moving assembly 24 drives the workpiece 200 to move in the first direction, the second moving assembly 25 drives the workpiece 200 to move in the second direction, and the movement compensation assembly 23 drives the workpiece 200 to move in the second direction for compensation. The polishing assembly 11 can rotate along its axis to polish the workpiece 200, the movement of the polishing assembly 11 and the rotation of the polishing angle of the workpiece 200 are driven by the carrying member 14.

The implementation process of the polishing apparatus 100 can be as follows: the workpiece 200 is fixed to the rotating mechanism 21, the controller controls the first moving assembly 24 and the second moving assembly 25 to drive the workpiece 200 to make a movement similar to the shape of the workpiece itself, so as to make the workpiece 200 contact with the polishing assembly 11, the controller controls the polishing assembly 11 to rotate to a preset angle, and the polishing assembly 11 can polish the workpiece 200 at a suitable polishing angle. Next, the controller controls the first moving assembly 24, the second moving assembly 25 and the rotating mechanism 21 to cooperate with each other to make the workpiece 200 perform profiling movements relative to the polishing assembly 11, until the workpiece 200 is satisfactorily polished. When the workpiece 200 moves relative to the polishing assembly 11, the sensor 22 senses the force applied to the workpiece 200 during polishing and transmits the force to the controller, and the controller determines whether the force is too large or too small. When the controller determines that the force is too large or too small, the controller further controls the movement compensation assembly 23 to drive the rotating mechanism 21 to move relative to the polishing assembly 11, and the force between the workpiece 200 and the polishing assembly 11 remains the preset range. For example, when the controller determines that the force is too large, the conflict between the workpiece 200 and the polishing assembly 11 is too tight, and the controller controls the movement compensation assembly 23 to drive the workpiece 200 to move away from the polishing assembly 11, and the force between the workpiece 200 and the polishing assembly 11 remains the preset range.

Referring to FIG. 3, the polishing apparatus 100 polishes the 3D surfaces of the workpiece 200, the 3D surfaces of the workpiece 200 can also be understood as an arced surface of the workpiece 200. The polishing assembly 11 of the polishing apparatus 100 rotates to a preset angle $\alpha$ to polish the 3D surface of the workpiece 200. When the polishing assembly 11 polishes the workpiece 200, the force sensed by the sensor 22 on the workpiece 200 is value F, and the force F can be composed of the horizontal force Fx and the vertical force Fz, $Fx=F\cos\alpha$, $Fz=F\sin\alpha$. The horizontal force on the workpiece 200 is Fx, and the vertical force is Fz. For example, when the horizontal force between the workpiece 200 and the polishing assembly 11 is Fx', and the vertical force is Fz', it means that the force between the workpiece 200 and the polishing assembly 11 remains the preset range. When Fx is greater than or less than Fx' and Fz is greater than or less than Fz', it means that the force between the workpiece 200 and the polishing assembly 11 is outside the preset range, and compensation needs to be applied by the polishing apparatus 100. For example, when Fx>Fx', it means that the horizontal force between the workpiece 200 and the polishing assembly 11 is too large. The controller controls the movement compensation assembly 23 to drive the workpiece 200 away from the polishing assembly 11 in the horizontal direction, so that Fx=Fx'. When Fx<Fx', it means that the horizontal force between the workpiece 200 and the polishing assembly 11 is insufficient. The controller controls the movement compensation assembly 23 to drive the workpiece 200 close to the polishing assembly 11 in the horizontal direction, so that Fx=Fx'. When Fz>Fz', it means that the vertical force between the workpiece 200 and the polishing assembly 11 is too large, and the controller controls the movement compensation assembly 23 to drive the workpiece 200 away from the polishing assembly 11 in the horizontal direction. In other embodiments, the controller can also control the polishing device 10 to make the polishing assembly 11 away from the workpiece 200 in the vertical direction, so that Fz=Fz'. When Fz<Fz', it means that the force in the vertical direction between the workpiece 200 and the polishing assembly 11 is insufficient. The controller controls the movement compensation assembly 23 to drive the workpiece 200 closer to the polishing assembly 11 in the horizontal direction. In other embodiments, the controller controls the polishing device 10 to drive the polishing assembly 11 closer to the workpiece 200 in the vertical direction, so that Fz=Fz'. Therefore, the force between the polishing assembly 11 and the workpiece 200 can be automatically adjusted. The polishing assembly 11 uniformly polishes the workpiece 200.

Referring to FIG. 4, the polishing apparatus 100 polishes the side surface of the workpiece 200. The polishing assembly 11 is perpendicular to the side surface of the workpiece 200 to polish the side surface of the workpiece 200. When the polishing assembly 11 polishes the workpiece 200, the sensor 22 senses that the force on the workpiece 200 is value F, the force F is composed of the force Fx in the horizontal direction, there being no force between the workpiece 200 and the polishing assembly 11 in the vertical direction. For example, when the force range in the horizontal direction between the workpiece 200 and the polishing assembly 11 is Fx', it means that the force between the workpiece 200 and the polishing assembly 11 remains the preset range. When Fx is greater than or less than Fx', it means that the force between the workpiece 200 and the polishing assembly 11 is outside the preset range. For example, when Fx>Fx', it means that the force in the horizontal direction between the workpiece 200 and the polishing assembly 11 is too large. The controller controls the movement compensation assembly 23 to drive the workpiece 200 away from the polishing assembly 11 in the horizontal direction, so that Fx=Fx'. When Fx<Fx', it means that the force in the horizontal direction between the workpiece 200 and the polishing assembly 11 is not enough. The controller controls the movement compensation assembly 23 to drive the workpiece 200 to approach the polishing assembly 11 in the horizontal direction, so that Fx=Fx'. Therefore, the force between the polishing assembly 11 and the workpiece 200 can be automatically adjusted. The polishing assembly 11 uniformly polishes the workpiece 200.

Referring to FIG. 5, the polishing apparatus 100 polishes the top surface of the workpiece 200. The polishing assembly 11 is perpendicular to the top surface of the workpiece 200 to polish the top surface of the workpiece 200. When the polishing assembly 11 polishes the workpiece 200, the sensor 22 senses that the force on the workpiece 200 is value F, the force F is composed of the vertical force Fz, there being no force between the workpiece 200 and the polishing assembly 11 in the horizontal direction. For example, when the force in the vertical direction between the workpiece 200 and the polishing assembly 11 is Fz', it means that the force between the workpiece 200 and the polishing assembly 11 remains the preset range. When Fz is greater than or less than Fz', it means that the force between the workpiece 200 and the polishing assembly 11 is outside the preset range, and the polishing apparatus 100 needs to be compensated. For example, when Fz>Fz', it means that the force in the vertical direction between the workpiece 200 and the polishing assembly 11 is too large, and the controller controls the movement compensation assembly 23 to drive the workpiece 200 away from the polishing assembly 11 in the vertical direction, or the controller controls the polishing device 10 to drive the polishing assembly 11 away from the workpiece 200 in the vertical direction, so that Fz-Fz'. When Fz<Fz', it means that the force in the vertical direction between the workpiece 200 and the polishing assembly 11 is not enough, and the controller controls the movement compensation assembly 23 to drive the workpiece 200 closer to the polishing assembly 11 in the vertical direction, or the controller controls the polishing device 10 to drive the polishing assembly 11 to closer the workpiece 200 in the vertical direction, so that Fz=Fz'. Therefore, the force between the polishing assembly 11 and the workpiece 200 is automatically adjusted. The polishing assembly 11 uniformly polishes the workpiece 200.

The embodiment provides a polishing apparatus 100, the workpiece 200 is polished by the polishing assembly 11 in the polishing device 10, and the sensor 22 in the polishing fixing device 20 senses the pressures exerted on the workpiece 200, the controller controls the movement compensation assembly 23 according to the sensed force to drive the rotating mechanism 21 to move relative to the polishing assembly 11, so that the force between the polishing assembly 11 and the workpiece 200 can be automatically adjusted, so that the force between the polishing assembly 11 and the workpiece 200 remains the preset range. The polishing assembly 11 can evenly polish the workpiece 200, which is conducive to improving the polishing quality and production efficiency of the workpiece 200.

In some embodiments, the controller can be a touch operation component. The touch operation component can include a processor, a memory, a display screen and other components. The processor is used to receive data, process data and send data. The memory is used to store data and instructions. The data and instructions can be read and executed by the processor. The display screen is used to display information, receive touch instructions, and send the touch instructions to the processor.

In other embodiments, the controller can also be a computer device, a central processing unit (CPU), a general-purpose processor, a digital signal processor (DSP), an application specific integrated circuit (ASIC), a field programmable gate array (FPGA) or other programmable logic devices Discrete gate or transistor logic devices, discrete hardware components, etc. The controller is the control center of the polishing apparatus 100 and uses various interfaces and lines to connect various parts of the entire polishing apparatus 100.

In some embodiments, the rotating mechanism 21 may include a fixing assembly 211 and a rotating assembly 212.

The fixing assembly 211 is used to fix the workpiece 200. The rotating assembly 212 is coupled with the controller. The rotating assembly 212 is located between the fixing assembly 211 and the movement compensation assembly 23 and is connected to the fixing assembly 211 and the movement compensation assembly 23. The rotating assembly 212 is used to drive the fixing assembly 211 and the workpiece 200 to rotate.

For example, the fixing assembly 211 can be used to fix one end of the workpiece 200 to fit the workpiece 200, and the fixing assembly 211 can be used to support the workpiece 200. The rotating assembly 212 includes a rotating shaft 2121, a coupling member 2122 and a rotating drive member 2123. One end of the rotating shaft 2121 is connected to the fixing assembly 211, and the fixing assembly 211 can rotate along the rotating shaft 2121. The coupling member 2122 is connected to the other end of the rotating shaft 2121. The rotating drive member 2123 is coupled to the controller and is connected to the coupling member 2122. The rotating drive member 2123 is used to drive the coupling member 2122 to drive the rotating shaft 2121 to rotate. The rotating drive member 2123 can be a servo motor, and the coupling member 2122 allows transmission of the driving force of the rotating drive member 2123 in different directions. Therefore, the structure of the rotating mechanism 21 is compact and stable.

In some embodiment, the rotating mechanism 21 further includes a rotating base 2124. The rotating base 2124 is substantially a short cylinder, and the diameter of the rotating base 2124 is larger than the diameter of the rotating shaft 2121. One end of the rotating base 2124 is connected to the fixing assembly 211, and the other end of the rotating base 2124 is connected to the rotating shaft 2121. Therefore, the connection between the fixing assembly 211 and the rotating assembly 212 is simple and stable. It is understood that the rotating base 2124 may also be omitted.

In other embodiments, the rotating drive member 2123 is connected to the rotating shaft 2121.

In other embodiments, one end of the fixing assembly 211 used to fix the workpiece 200 can also be a suction cup or a vacuum nozzle, the suction cup or the vacuum nozzle adsorbs the workpiece 200 through a negative pressure to prevent bumping, scratching, and crushing of the workpiece 200 when the fixing assembly 211 fixes the workpiece 200.

Referring to FIG. 6, in some embodiments, the sensor 22 may include a sensing housing 221, a sensing member 222, a signal transmission member 223, and a sealing member 224 arranged on the sensing housing 221. The sensing housing 221 is circular and plate shaped. The sensing member 222 is used to sense the force applied to the workpiece 200 during polishing, and the sensing member 222 is located in the middle of the sensing housing 221. The sealing member 224 surrounds the sensing member 222 and is arranged on the sensing housing 221. The sealing member 224 can be a rubber ring or a silicone ring. The sealing member 224 seals and protects the sensing member 222 to prevent damage to the sensing member 222 due to contamination by a polishing liquid or dust. The signal transmission member 223 is connected to the sensing member 222 and protrudes out of the sensing housing 221 for coupling with the controller. The signal transmission member 223 is used to transmit the data output by the sensing member 222.

The sensing housing 221 is located between the rotating mechanism 21 and the movement compensation assembly 23 and is connected to the rotating mechanism 21 and the movement compensation assembly 23. The sensing member 222 is butted against the rotating mechanism 21 to sense the force experienced by the rotating mechanism 21.

In other embodiments, the sensing housing 221 is located between the fixing assembly 211 and the rotating assembly 212, and the sensing housing 221 is connected to the fixing assembly 211 and the rotating assembly 212. The sensing member 222 is butted against the fixing assembly 211. The movement compensation assembly 23 is connected to the rotating assembly 212.

In some embodiments, the polishing fixing device 20 further includes a connecting plate 26. The connecting plate 26 is in the form of a plate. The connecting plate 26 is located between the rotating mechanism 21 and the sensing housing 221, and the connecting plate 26 is connected to the rotating mechanism 21 and the sensing housing 221. The connecting plate 26 carries the rotating mechanism 21, which is conducive to stress conduction and improves the induction accuracy of the inductor 22, reducing the error.

In other embodiments, when the sensing housing 221 of the sensor 22 is located between the fixing assembly 211 and the rotating assembly 212, the connecting plate 26 should be located between the fixing assembly 211 and the sensing housing 221 and connected to the fixing assembly 211 and the sensing housing 221.

In some embodiments, the sensing member 222 projects out of the sealing member 224 towards the direction facing the connecting plate 26, which can be understood as along the Z-axis direction, as shown in FIG. 6, the sensing member 222 is higher than the sealing member 224 to render the sensing member 222 slightly convex. The side of the connecting plate 26 facing the sensing housing 221 is provided with a butting portion 261. When the connecting plate 26 is connected to the sensing housing 221, the butting portion 261 is butted against the sensing member 222. Therefore, the connecting plate 26 and the sensing member 222 are closely connected, which improves the sensing accuracy of the sensing member 222 and reduces the error.

In other embodiments, the sensing member 222 can protrude from the side of the sensing housing 221 facing the connecting plate 26. Therefore, the sensing member 222 and the connecting plate 26 are closely connected, which improves the sensing accuracy of the sensing member 222 and reduces the error.

Referring to FIG. 7, in some embodiments, the movement compensation assembly 23 includes a housing 231, a movement guide rail 232, a movement transmission member 233, a movement sliding plate 234, and a movement driving member 235.

The housing 231 is used to accommodate and carry the bearing movement guide rail movement guide rail 232, the movement transmission member 233, the movement sliding plate 234, and the mobile transmission part movement driving member 235. The housing 231 is connected to the first moving assembly 24. The number of the movement guide rails 232 is two, and the two movement guide rails 232 are relatively arranged in the housing 231 and extend in the direction of movement compensation. In the embodiment, the direction of the movement compensation is the first direction, closer to or farther from the polishing assembly 11 along the X axis, so that the force between the polishing assembly 11 and the workpiece 200 remains the preset range. The movement transmission member 233 is rotatably arranged on the housing 231 and located between the two movement guide rails 232. The movement transmission member 233 extends in the direction of motion compensation. The movement sliding plate 234 is plate shaped. One side of the movement sliding plate 234 is slidably connected to the movement transmission member 233 and the movement guide rail 232. The other side of the movement sliding plate 234 is connected to the rotating mechanism 21 or the sensing housing 221. The movement driving member 235 is coupled to the controller, the movement driving member 235 is arranged on the housing 231 and connected to the movement transmission member 233, and the movement driving member 235 is used to drive the movement transmission member 233 to rotate, so that the movement sliding plate 234 moves along the extension direction of the movement guide rail 232.

In some embodiment, the movement compensation assembly 23 may further include a sliding block 236 and a movement sliding member 237. The number of the sliding blocks 236 is four, two of which are arranged on one movement guide rail 232. The movement sliding member 237 is slidably arranged on the movement transmission member 233, and the movement sliding member 237 moves relative to the movement transmission member 233 when the movement transmission member 233 rotates. One side of the movement sliding plate 234 is connected to the sliding block 236 and the movement sliding member 237 and moves along the extension direction of the movement guide rail 232 with the movement sliding member 237. The movement transmission member 233 and the movement sliding member 237 can be a ball screw structure. The movement driving member 235 can be a servo motor. The movement transmission member 233 is rotatably connected to the housing 231 through a bearing. The number of the sliding blocks 236 can also be two, three, five, six or more.

In other embodiments, the movement compensation assembly 23 can be a cylinder mechanism moving linearly, the rotating mechanism 21 or the sensing housing 221 being connected to the output end of the cylinder mechanism. In this way, the movement compensation assembly 23 can still realize movement in compensation of the workpiece 200.

Referring to FIG. 8, in some embodiments, the first moving assembly 24 may include a first housing 241, a first guide rail 242, a first transmission member 243, a first sliding plate 244, a first driving member 245, a first sliding block 246, a first sliding seat 247, and a first buffering member 248.

The first housing 241 is used to accommodate and carry the first guide rail 242, the first transmission member 243, the first sliding plate 244, the first driving member 245, the first sliding block 246, the first sliding seat 247 and the first buffering member 248, the first housing 241 is connected to the second moving assembly 25. The number of the first guide rails 242 is two. The two first guide rails 242 are opposite to each other in the first housing 241 and extend along the first direction, the number of the first sliding blocks 246 is four, two of which are arranged on the first guide rail 242. The first transmission member 243 is arranged in the first housing 241 between the two first guide rails 242, and the first transmission member 243 extends along the first direction. The first sliding seat 247 is slidably arranged on the first transmission member 243. The first driving member 245 is connected to one end of the first transmission member 243. The first driving member 245 is used to drive the first transmission member 243 to rotate relative to the first sliding seat 247, so that the first sliding seat 247 moves along the first transmission member 243, and the first sliding seat 247 moves along the first direction. The first sliding plate 244 is plate shaped, and one side of the first sliding plate 244 is connected to the first sliding seat 247 and the first sliding block 246. The first sliding plate 244 is driven by the first sliding seat 247 to move in the first direction. The other side of the first sliding plate 244 is connected to the housing 231 of the movement compensation assembly 23, so that the movement compensation assembly 23 moves in the first direction when driven by the first sliding plate 244. The number of the first buffering members 248 is two, respectively arranged on either side of the first sliding plate 244 along the first direction. The first buffering member 248 has elasticity, and the first buffering member 248 provides buffering when the first sliding plate 244 moves too far along the first direction.

In other embodiments, the first sliding plate 244 and the first buffering member 248 can be omitted. In this way, the first sliding seat 247 is directly connected to the housing 231.

The first transmission member 243 and the first sliding seat 247 can be a ball screw structure, the first driving member 245 can be a servo motor. The first transmission member 243 is rotatably connected to the first housing 241 through the bearing structure. The first buffering member 248 may be an elastic member made of rubber material. The first buffering member 248 may also be a spring or other elastic component, and the number of first sliding blocks 246 may be two, three, five, six or more.

In other embodiments, the first moving assembly 24 can be a cylinder mechanism moving linearly, and the housing 231 is connected to the output end of the first moving assembly 24. Therefore, the first moving assembly 24 can still achieve movement of the movement compensation assembly 23 in the first direction.

In some embodiments, the second moving assembly 25 may include a second housing 251, a second guide rail 252, a second transmission member 253, a second sliding plate 254, a second driving member 255, a second sliding block 256, a second sliding seat 257, and a second buffering member 258.

The second housing 251 is used to accommodate and carry the second guide rail 252, the second transmission member 253, the second sliding plate 254, the second driving member 255, the second sliding block 256, the second sliding seat 257 and the second buffering member 258. The second housing 251 can be the supporting structure of the polishing fixing device 20. The number of the second guide rails 252 is two. The two second guide rails 252 are opposite to each other in the second housing 251 and extend along the second direction. The number of the second sliding blocks 256 is four, two of which are arranged on a second guide rail 2. The second transmission member 253 is arranged in the second housing 251 between two second guide rails 252, and the second transmission member 253 extends in the second direction. The second sliding seat 257 is slidably arranged on the second transmission member 253. The second driving member 255 is connected to one end of the second transmission member 253. The second driving member 255 is used to drive the second transmission member 253 to rotate relative to the second sliding seat 257, so that the second sliding seat 257 moves along the second transmission member 253, and the second sliding seat 257 moves along the second direction. One side of the second sliding plate 254 is connected to the second sliding seat 257 and the second sliding block 256. The second sliding plate 254 is driven by the second sliding seat 257 to move in the second direction. The other side of the second sliding plate 254 is connected to the first housing 241, so that the first moving assembly 24 moves in the second direction when driven by the second sliding plate 254. The number of the second buffering members 258 is two, respectively arranged on either side of the second sliding plate 254 along the second direction. The second buffering member 258 has elasticity, and the second buffering member 258 provides buffering when the second sliding plate 254 moves too far in the second direction.

In other embodiments, the second sliding plate 254 and the second buffering member 258 can be omitted. In this way, the second sliding seat 257 is connected to the first housing 241.

The second transmission member 253 and the second sliding seat 257 can be a ball screw structure, and the second driving member 255 can be a servo motor, the second transmission member 253 is rotatably connected to the second housing 251 through a bearing structure, and the second buffering member 258 can be an elastic element made of rubber material. In other embodiments, the second buffering member 258 can also be a spring or other elastic component, and the number of the second sliding blocks 256 can also be two, three, five, six or more.

In other embodiments, the second moving assembly 25 can also be a cylinder mechanism moving linearly, and the first housing 241 is connected to the output end of the second moving assembly 25. In this way, the second moving assembly 25 can still achieve movement of the first moving assembly 24 in the second direction.

Referring to FIG. 9, in some embodiments, the polishing device 10 may further include a driving assembly 12 and a third moving assembly 13.

The driving assembly 12 is coupled to the controller and connected to the polishing assembly 11, the driving assembly 12 is used to drive the polishing assembly 11 to rotate along an axis, to adjust the polishing angle of the polishing assembly 11 relative to the workpiece 200. The third moving assembly 13 is coupled to the controller and connected to the driving assembly 12. The third moving assembly 13 is used to drive the driving assembly 12 and the polishing assembly 11 to move in a third direction, the third direction being different from the first direction and the second direction, so that the polishing assembly 11 is brought closer to or farther from the workpiece 200. The third direction is the Z-axis direction as shown in FIG. 9, and the third direction is perpendicular to the first direction and the second direction.

In some embodiments, the polishing device 10 may further include a carrying member 14 and a bracket 15.

The polishing assembly 11 is arranged on the carrying member 14. The carrying member 14 is rotatably arranged on the bracket 15 and is connected to the driving assembly 12. The driving assembly 12 is connected to the bracket 15. The driving assembly 12 is used to drive the carrying member 14 to rotate along an axial direction, so that the polishing assembly 11 rotates along an axial direction. The controller controls the driving assembly 12 to drive the carrying member 14 to rotate along the axis of the carrying member 14. The bracket 15 is connected to the third moving assembly 13. The bracket 15 drives the driving assembly 12, and the carrying member 14 and the polishing assembly 11 along the third direction under the drive of the third moving assembly 13. The axial direction is the axis of the carrying member 14.

In other embodiments, the number of the polishing assemblies 11 can also be two, three or more, and two, three or more. The polishing assembly 11 is arranged on different surfaces of the carrying member 14, to allow polishing of the workpiece 200 with different surfaces, reduce the wear of the single polishing assembly 11, and help to improve the service life of the polishing apparatus 100.

In some embodiments, the third moving assembly 13 may include a third housing 131, a third guide rail 132, a third transmission member 133, a third sliding plate 134, a third driving member 135, a third sliding block 136, a third sliding seat 137, and a third buffering member 138.

The third housing 131 is used to accommodate and carry the third guide rail 132, the third transmission member 133, the third sliding plate 134, the third driving member 135, the third sliding block 136, the third sliding seat 137, and the third buffering member 138. The third housing 131 can be used as a support structure of the polishing device 10. The number of the third guide rails 132 is two, and the two third guide rails 132 are arranged in the third housing 131 and extend along the third direction. The number of the third sliding blocks 136 is four, two of which are arranged on a third guide rail 132. The third transmission member 133 is arranged in the third housing 131 between the two third guide rails 132, and the third transmission member 133 extends in the third direction. The third sliding seat 137 is slidably arranged on the third transmission member 133. The third driving member 135 is connected to one end of the third transmission member 133, the third driving member 135 is used to drive the third transmission member 133 to rotate relative to the third sliding seat 137, so that the third sliding seat 137 moves along the third transmission member 133, and the third sliding seat 137 moves along the third direction. The third sliding plate 134 is plate shaped, one side of the third sliding plate 134 is connected to the third sliding seat 137 and the third sliding block 136, and the third sliding plate 134 moves in the third direction under the driving of the third sliding seat 137. The other side of the third sliding plate 134 is connected to the bracket 15, so that the bracket 15 moves in the third direction under the driving of the third sliding plate 134. The number of the third buffering members 138 is two, respectively arranged on either side of the third sliding plate 134 along the third direction, the third buffering member 138 has elasticity, and the third buffering member 138 provides buffering when the third sliding plate 134 moves excessively in the third direction.

In other embodiments, the third sliding plate 134 and the third buffering member 138 can be omitted. In this way, the third sliding seat 137 is directly connected to the bracket 15.

The third transmission member 133 and the third sliding seat 137 can be a ball screw structure, and the third driving member 135 can be a servo motor, the third transmission member 133 is rotatably connected to the third housing 131 through a bearing structure. The third buffering member 138 can be an elastic part made of rubber material. The third buffering member 138 may also be a spring or other elastic component, and the number of the third sliding blocks 136 may be two, three, five, six or more.

In other embodiments, the third moving assembly 13 can also be a cylinder mechanism, and the bracket 15 is connected to the output end of the third moving assembly 13. Therefore, the third moving assembly 13 can still realize movement of the bracket 15 along the third direction.

The polishing apparatus 100 can automatically adjust the pressure between the polishing assembly 11 and the workpiece 200 through the mutual cooperation of the rotating mechanism 21, the sensor 22, the movement compensation assembly 23, the first moving assembly 24, the second moving assembly 25, the controller, the driving assembly 12, and the third moving assembly 13, so that pressure between the polishing assembly 11 and the workpiece 200 remains the preset range. The polishing assembly 11 can evenly polish the workpiece 200, which can ensure the polishing quality of the workpiece 200 and further improve the production efficiency of the workpiece 200.

For example, the controller controls the rotating mechanism 21 to drive the workpiece 200 to rotate the second preset angle relative to the polishing assembly 11, and controls at least one of the first moving assembly 24 to drive the workpiece 200 to move along the first direction and the second moving assembly 25 to drive the workpiece 200 to move along the second direction. When the workpiece 200 rotates relative to the polishing assembly 11, another corner of the workpiece 200 moves and rubs against the polishing assembly 11 for polishing. The second preset angle can be 90°. After the rotating mechanism 21 drives the workpiece 200 to rotate the second preset angle relative to the polishing assembly 11, the long side of the workpiece 200 close to the polished arc angle is in contact with the polishing assembly 11, and the workpiece 200 returns to the initial position.

the workpiece 200 is controlled to move along the direction of compensation movement to compensate the preset distance, so that the force exerted by the workpiece 200 when it meets the workpiece 200 remains the preset range.

For example, when the force sensed by the sensor 22 exceeds the preset range, the controller controls the movement compensation assembly 23 to drive the workpiece 200 to move along the direction of compensation movement to compensate the preset distance, so that the workpiece 200 is closer to or farther from the polishing assembly 11, and the force exerted by the workpiece 200 when it meets the workpiece 200 falls within the preset range.

Referring to FIG. 10, The present disclosure further provides a polishing apparatus 300, the polishing apparatus 300 is used to polish the workpiece 200 continuously and by cyclic polishing of the workpiece 200. The polishing apparatus 300 includes a polishing device 10, a polishing fixing device 20 provided in the above embodiment, and a controller 30. The controller 30 may be a controller in the polishing apparatus 100.

In the embodiment, the polishing apparatus 300 further includes a rotating device 50, and the polishing device 10 corresponds to the processing station 40. The processing station 40 can be understood as the position where the workpiece 200 on the polishing fixing device 20 is polished. In the embodiment, the number of processing stations 40 is three. According to different production requirements, the number of the processing stations 40 can also be one, two, four, five, six or more.

The rotating device 50 is coupled to the controller 30, and the rotating device 50 is connected to the polishing fixing device 20. The controller 30 controls the rotating device 50 to rotate relative to the processing station 40, to drive the polishing fixing device 20 to the processing station 40, to correspond to the polishing device 10. In the embodiment, the number of polishing devices 10 is three, and the number of polishing fixing devices 20 is four, corresponding to the number of the processing stations 40. Each polishing fixing device 20 corresponds to a processing station 40, and three polishing devices 10 correspond to three processing stations 40. A transmission station 42 is used to place the workpiece 200 on the polishing fixing device 20. The transmission station 42 is used to take the workpiece 200 from the polishing fixing device 20, to realize the loading and unloading of the workpiece 200.

Referring to FIG. 10 and FIG. 11, each polishing fixing device 20 corresponds to a processing station 40, three polishing devices 10 correspond to three processing stations 40, and the transmission station 42 is used for loading and unloading the workpiece 200.

To facilitate understanding, in this implementation process, three processing stations 40 are defined as the first processing station, the second processing station, and the third processing station, set respectively in a counterclockwise direction. Four polishing fixing devices 20 are defined as the first polishing fixing device, the second polishing fixing device, the third polishing fixing device, and the fourth polishing fixing device, and the polishing device 10 are defined as the first polishing device, the second polishing device, and third polishing device. The initial state of the polishing apparatus 100 is that the first polishing fixing device, the second polishing fixing device, the third polishing fixing device, and the fourth polishing fixing device are located at the transmission station 42, the first processing station, the second processing station, and the third processing station, the first polishing device, the second polishing device, and the third polishing device are respectively located in the first processing station, the second processing station, and the third processing station, the transmission station 42 is used for loading and unloading the workpiece 200. Taking the counterclockwise rotation of the rotating device 50 as an example.

Firstly, the workpiece 200 is placed on the first polishing fixing device, the second polishing fixing device, the third polishing fixing device, and the fourth polishing fixing device, respectively located in the first processing station, the second processing station, and the third processing station, and correspond to the first polishing device, the second polishing device, and the third polishing device. Then, the controller 30 controls the rotating device 50 to rotate relative to the processing station 40, and the first polishing fixing device rotates to the first processing station, and the second polishing fixing device, the third polishing fixing device, and the fourth polishing fixing device are respectively located at the second processing station, the third processing station, and the transmission station 42; furthermore, the controller 30 controls the workpiece 200 on the first polishing fixing device to move relative to the first polishing fixing device for the first polishing; furthermore, at the transmission station 42, the workpiece 200 is placed on the fourth polishing fixing device; furthermore, after the first polishing of the first processing station is completed, the controller 30 controls the rotating device 50 to rotate relative to the processing station 40, the first polishing fixing device rotates to the second processing station, and the fourth polishing fixing device rotates to the first processing station, the second polishing fixing device, and the third polishing fixing device are respectively located in the third processing station and the transmission station 42; furthermore, the controller 30 controls the workpiece 200 on the fourth polishing fixing device to move relative to the first polishing fixing device for the first polishing, and controls the workpiece 200 on the first polishing fixing device to move relative to the second polishing fixing device for the second polishing; furthermore, the workpiece 200 at the transmission station 42, is placed on the polishing assembly 11 of the third polishing fixing device; furthermore, after the first processing station finishes the first polishing and the second processing station finishes the second polishing, the controller 30 controls the rotating device 50 to rotate relative to the processing station 40, the first polishing fixing device rotates to the third processing station, the fourth polishing fixing device rotates to the second processing station, and the third polishing fixing device rotates to the first processing station, and the second polishing fixing device is located at the transmission station 42; furthermore, the controller 30 controls the workpiece 200 on the third polishing fixing device to move relative to the first polishing fixing device for the first polishing, controls the workpiece 200 on the fourth polishing fixing device to move relative to the second polishing fixing device for the second polishing, and controls the workpiece 200 on the first polishing fixing device to move relative to the third polishing fixing device for the third polishing; furthermore, the workpiece 200 at the transmission station 42, is placed on the second polishing fixing device; furthermore, after the first processing station finishes the first polishing, the second processing station finishes the second polishing, and the third processing station finishes the third polishing, the controller 30 controls the rotating device 50 to rotate relative to the processing station 40, the first polishing fixing device rotates to the transmission station 42, the fourth polishing fixing device rotates to the third processing station, the third polishing fixing device rotates to the second processing station, and the second polishing fixing device rotates to the first processing station; furthermore, the controller 30 controls the workpiece 200 on the second polishing fixing device to move relative to the first polishing fixing device for the first polishing, controls the workpiece 200 on the third polishing fixing device to move relative to the second polishing fixing device for the second polishing, and controls the workpiece 200 on the fourth polishing fixing device to move relative to the third polishing fixing device for the third polishing; furthermore, since the workpiece 200 on the first polishing fixing device is polished after the first polishing, the second polishing, and the third polishing, the polished workpiece 200 is removed from the first polishing fixing device, and a new workpiece 200 is placed for polishing on the first polishing fixing device. In this way, the rotating device 50 drives the polishing fixing device 20 to rotate circularly, so that the workpiece 200 on each polishing fixing device 20 is polished for a first time, a second time, and a third time in turn. The first polishing device, the second polishing device, and the third polishing device on the polishing apparatus 100 work at the same time, while the transmission station 42 realizes loading and unloading of the workpiece 200, which does not affect the polishing of the workpiece 200 by the polishing device 10. The present disclosure improves the polishing efficiency of the workpiece 200.

The first polishing is the rough polishing of the workpiece 200, the second polishing is a finer polishing of the workpiece 200, and the third polishing is the final polishing of the workpiece 200.

In the embodiment, the polishing apparatus 300 can also include a polishing moving mechanism 80. The polishing moving mechanism 80 is coupled to the controller 30 and slidably connected to the polishing device 10. The polishing moving mechanism 80 is used to move the polishing device 10 to the processing station 40. In this way, the present disclosure can realize the movement of the polishing device 10 relative to the polishing fixing device 20.

In the embodiment, the polishing apparatus 300 can also include a supply device 60, supplying polishing liquid, which is arranged adjacent to the rotating device 50. The supply device 60 is used to supply the polishing liquid when the workpiece 200 is being polished at the processing station 40. The polishing liquid can reduce the temperature between the polishing device 10 and the workpiece 200, and avoid color change, deformation, and other problems of the workpiece 200 due to high temperatures, it also has the properties of degreasing, cleaning, rust prevention, polishing, etc., which is conducive to improving the polishing quality of the workpiece 200. The polishing liquid can be polycrystalline diamond polishing liquid, silicon oxide polishing liquid, cerium oxide polishing liquid, aluminum oxide, silicon carbide polishing liquid, etc.

In the embodiment, the polishing apparatus 300 further includes a liquid collecting tank 70, the liquid collecting tank 70 matches with a rotating device 50. The rotating device 50 is arranged in the liquid collecting tank 70, and the liquid collecting tank 70 is used to collect waste polishing liquid discharged from the rotating device 50.

In the embodiment, the liquid collecting tank 70 includes an installation area 71 for mounting at least part of the rotating device 50, the installation area 71 is separated by an installation member 72, and the installation member 72 is roughly cylindrical. The area of the liquid collecting tank 70 except the installation area 71 can collect the polishing liquid. The installation member 72 also has the function of a barrier to prevent the polishing liquid from flowing into the rotating device 50.

In the embodiment, the polishing apparatus 300 further includes a frame 90. The frame 90 is used to carry the liquid collecting tank 70, the polishing device 10, the polishing moving mechanism 80, the polishing fixing device 20, and the rotating device 50. The polishing liquid supply device 60 can be arranged on or adjacent to the frame 90. The controller 30 can be arranged on or adjacent to the frame 90.

Referring to FIG. 12, in the embodiment, the rotating device 50 includes a rotating plate 51 and a driving mechanism 52. The rotating plate 51 is substantially square with rounded corners. Four polishing fixing devices 20 are equally arranged on the rotating plate 51. The driving mechanism 52 is connected to the rotating plate 51, and the driving mechanism 52 is used to drive the rotating plate 51 to rotate, thereby driving the polishing fixing device 20 to rotate. In other embodiments, the rotating plate 51 may also be circular or square.

In some embodiments, the driving mechanism 52 includes a rotary splitter 521, a servo motor drives the rotary splitter 521 to rotate. The rotary splitter 521 is used to control the rotation of the rotating plate 51, so that the rotating plate 51 drives the polishing fixing device 20 to the processing station 40. In the embodiment, the rotary splitter 521 is used to control the rotating plate 51 to rotate 90° per step, of the rotating plate 51, the polishing fixing device 20 is moved to the adjacent processing station 40 or the transmission station 42.

In other embodiments, when the number of the processing stations 40 and the transmission stations 42 is two, three, five, six or more, the rotary splitter 521 controls the rotating plate 51 to rotate a corresponding number of degrees per step, that is, 180°, 120°, 72°, or 60°. The number of the polishing fixing devices 20 is equal to the number of the processing stations 40 and the transmission stations 42.

In the embodiment, the rotating device 50 includes an isolating cover 53, the isolating cover 53 is roughly cylindrical, and is arranged between the rotating plate 51 and the driving mechanism 52. The isolating cover 53 is located in the installation area 71 of the liquid collecting tank 70. The isolating cover 53 is used to prevent the polishing liquid from entering the driving mechanism 52 when it is discharged into the liquid collecting tank 70. The driving mechanism 52 is thus protected from being polluted by polishing liquid through the cooperation of the isolating cover 53 and the installation member 72, ensuring the normal and stable operation of the driving mechanism 52.

In the embodiment, the rotating device 50 further includes a slip ring assembly 54, the slip ring assembly 54 is arranged on the side of the rotating plate 51 away from the driving mechanism 52. The slip ring assembly 54 can supply electricity to the polishing fixing device 20 on the rotating plate 51, so that when the polishing fixing device 20 rotates with the rotating plate 51, the electrical circuit remains stable.

In some embodiments, the rotating plate 51 can be provided with a guide groove (not shown in the figure), which is used to guide the polishing liquid on the rotating plate 51. The guide groove can be a through hole through the rotating plate 51, and the through hole is connected to the liquid collecting tank 70. Thereby, the polishing liquid can be discharged into the liquid collecting tank 70 as soon as possible after it falls on the rotating plate 51.

Referring to FIG. 13, the polishing device 10 is slidably connected to the polishing moving mechanism 80, which drives the polishing device 10 towards or away from the polishing fixing device 20. In the embodiment, the polishing moving mechanism 80 drives the polishing device 10 towards or away from the polishing fixing device 20 along the first direction. The first direction is the X axis direction as shown in FIG. 2.

The polishing moving mechanism 80 includes a housing 81, a movement slide rail 82, a movement transmission member 83, a movement sliding member 84, a sliding block 85, a movement sliding plate 86, a movement driving member 87, and two movement buffering members 88.

The housing 81 is used for carrying the movement slide rail 82, the movement transmission member 83, the movement sliding member 84, the sliding block 85, the movement sliding plate 86, the movement driving member 87, and two movement buffering members 88. The movement slide rail 82 is arranged on the housing 81 and extends along the first direction, one end of the polishing device 10 is connected to the movement transmission member 83, and the other end of the movement sliding member 84 is connected to the movement sliding plate 86. One end of the movement sliding plate 86 connected to the movement sliding member 84 is also connected to the sliding block 85, the sliding block 85 slides on the movement slide rail 82, the movement sliding plate 86 is away from the movement sliding member 84, and one side of the sliding block 85 is connected to the rotating mechanism 21. The two movement buffering members 88 are arranged on both sides of the movement sliding plate 86 along the first direction. The movement driving member 87 is arranged on the housing 81 and connected to the movement transmission member 83. The movement driving member 87 is used to drive the movement transmission member 83 to rotate, so that the movement sliding member 84 moves along the movement transmission member 83, thereby moving the sliding block 85, the movement sliding plate 86 and the polishing device 10 along the movement slide rail 82.

The movement transmission member 83 and the movement sliding member 84 can be a ball screw mechanism. The movement driving member 87 can be a servo motor, and the movement transmission member 83 can be rotatably connected to the housing 81 through a bearing. The number of movement slide rails 82 and sliding blocks 85 is two. The movement sliding plate 86 is plate shaped. The two movement buffering members 88 may be elastic elements made of rubber materials. The moving buffer movement buffering member 88 can also be a spring or other elastic component, and the number of the sliding blocks 85 can also be four, six or more.

In other embodiments, the polishing moving mechanism 80 can also be a cylinder mechanism, so the polishing device 10 is connected to the output end of the polishing moving mechanism 80. Therefore, the polishing moving mechanism 80 can still move the polishing device 10 in the first direction.

The polishing apparatus 300 provided in the embodiment can realize automatic polishing of the workpiece 200 through the mutual cooperation of the polishing device 10, the polishing fixing device 20, the controller 30, the processing station 40, the transmission station 42, the rotating device 50, the polishing moving mechanism 80, the polishing liquid supply device 60, and the liquid collecting tank 70. Automatic polishing of the workpiece 200 is highly efficient, which is conducive to improving the production efficiency of the workpiece 200. The present disclosure can ensure the polishing quality of the workpiece 200 and improve the production yield and overall efficiency of the workpiece 200 through the cooperation between the sensor 22 of the polishing fixing device 20 and the movement compensation assembly 23. The rotating device 50 drives the polishing fixing device 20 to rotate circularly, so that the workpiece 200 on the polishing fixing device 20 will be moved relative to the polishing device 10 on the processing station 40 for polishing. When the workpiece 200 is loaded and unloaded, other workpieces 200 are not affected by the polishing device 10. The present disclosure improves the polishing efficiency of the workpiece 200.

Those of ordinary skill in the art should realize that the above embodiments are only used to illustrate the present disclosure, but not to limit the present disclosure. As long as they are within the essential spirit of the present disclosure, the above embodiments are appropriately made and changes fall within the scope of protection of the present disclosure.

What is claimed is:

1. A polishing apparatus comprising:

a polishing device for polishing a workpiece;

at least one polishing fixing device comprising:

a rotating mechanism for fixing and driving a workpiece to rotate relative to a polishing assembly, and the workpiece polished by the polishing assembly;

a sensor coupled to the rotating mechanism, and the sensor for sensing a force applied on the workpiece when the workpiece being polished;

a movement compensation assembly connected to the rotating mechanism and coupled to the sensor, and the movement compensation assembly for driving the rotating mechanism to move relative to a polishing assembly, thereby regulating the force applied on the workpiece;

a first moving assembly connected to the movement compensation assembly, and the first moving assembly for driving the movement compensation assembly and the rotating mechanism to move along a first direction, to make the workpiece move along the first direction to be polished;

a second moving assembly connected to the first moving assembly, and the second moving assembly for driving the first moving assembly to move along a second direction, to make the workpiece move along the second direction to be polished; and a connecting plate arranged between the rotating mechanism and the sensor, the connecting plate being connected to the rotating mechanism and the sensor;

wherein the sensor is arranged between the connecting plate and the movement compensation assembly and is connected to the rotating mechanism and the movement compensation assembly; and wherein the sensor comprises a sensing housing and a sensing member disposed in the sensing housing, one side of the connecting plate facing the sensing housing is provided with a butting portion, when the connecting plate is connected to the sensing housing, the butting portion is butted against the sensing member;

a controller coupled to the polishing fixing device, and the controller for controlling the at least one of the polishing fixing device to drive the workpiece to rotate relative to a processing station, to move along the first direction and move along the second direction, thereby the workpiece being moved relative to the polishing device for polishing; and a rotating device coupled to the controller, and connected to the at least one polishing fixing device;

wherein the controller controls the rotating device to rotate relative to the processing station, to drive the at least one polishing fixing device to the processing station, to be correspondingly positioned to the polishing device.

2. The polishing apparatus of claim 1, wherein the rotating device comprises a rotating plate and a driving mechanism; wherein the rotating plate is connected to the at least one polishing fixing device, and the driving mechanism is connected to the rotating plate, and the driving mechanism is for driving the rotating plate to rotate relative the processing station.

3. The polishing apparatus of claim 2, further comprising:

a polishing liquid supply device for supplying polishing liquid to the workpiece when the workpiece is positioned at the processing station;

wherein the rotating device further comprises an isolating cover, and the isolating cover is arranged between the rotating plate and the driving mechanism, the isolating cover is for shielding the driving mechanism from the polishing liquid.

4. The polishing apparatus of claim 3, wherein the rotating plate comprises a guide groove, the guiding groove is for guiding the polishing liquid, and wherein the polishing apparatus further comprises a liquid collecting tank, the liquid collecting tank is adapted to the rotating device, and the liquid collecting tank is for collecting the polishing liquid discharged from the rotating device.

5. The polishing apparatus of claim 1, further comprising:

a polishing moving mechanism coupled to the controller and slidably connected to the polishing device, and the polishing moving mechanism for moving the polishing device to the processing station.

6. The polishing apparatus of claim 5, wherein the polishing device comprises a bracket, a polishing mechanism, and a third moving assembly; wherein the bracket slidably is connected to the polishing moving mechanism; and the polishing mechanism is slidably connected to the bracket, the third moving assembly is coupled to the controller, and connected to the polishing mechanism, and the third moving assembly is for driving the polishing mechanism to move along a third direction on the bracket; wherein the third direction is different from the first direction and the second direction.

* * * * *